United States Patent [19]

Oliveau et al.

[11] Patent Number: 5,041,123

[45] Date of Patent: Aug. 20, 1991

[54] DEPILATING APPARATUS

[75] Inventors: Patrice Oliveau, Fontaine; Gilbert Brochet, Villeurbanne, both of France

[73] Assignee: SEB S.A., France

[21] Appl. No.: 485,593

[22] Filed: Feb. 27, 1990

[30] Foreign Application Priority Data

Jun. 16, 1989 [FR] France ..... 89 08038

[51] Int. Cl.[5] ..... A61B 17/50

[52] U.S. Cl. ..... 606/133

[58] Field of Search ..... 606/131, 133; 452/82-85; 132/73, 73.6

[56] References Cited

U.S. PATENT DOCUMENTS 1,791,843 2/1931 Reiss ..... 452/83

4,079,741 3/1978 Daar et al. ..... 452/84

FOREIGN PATENT DOCUMENTS 788130 7/1935 France .

0147285 7/1985 France .

*Primary Examiner*—Stephen C. Pellegrino

*Assistant Examiner*—Steven J. Shumaker

*Attorney, Agent, or Firm*—Finnegan, Henderson, Farabow, Garrett & Dunner

[57] ABSTRACT

The depilating apparatus comprises a series of parallel disks (2) fixed on a hub (3) driven in rotation by an electric motor, and blades (9) arranged between the disks, and rods (10) for bringing said blades (9) into contact with the periphery (2*a*) of the disks (2).

The hub (3) comprises, between the disks (2), a series of notches (11) which each retain one end of a blade (9), each rod (10) comprising a series of notches (12) open towards the notches (11) of the hub, each notch (12) of a rod (10) retaining a part of a blade (9). The notches (11, 12) are shaped so as to permit a pivoting movement of the blades (9) between a position remote from the disks (2) and a position in contact with the periphery (2*a*) of the latter.

Use for removing hair from the skin.

16 Claims, 4 Drawing Sheets

DEPILATING APPARATUS

Figure 1:
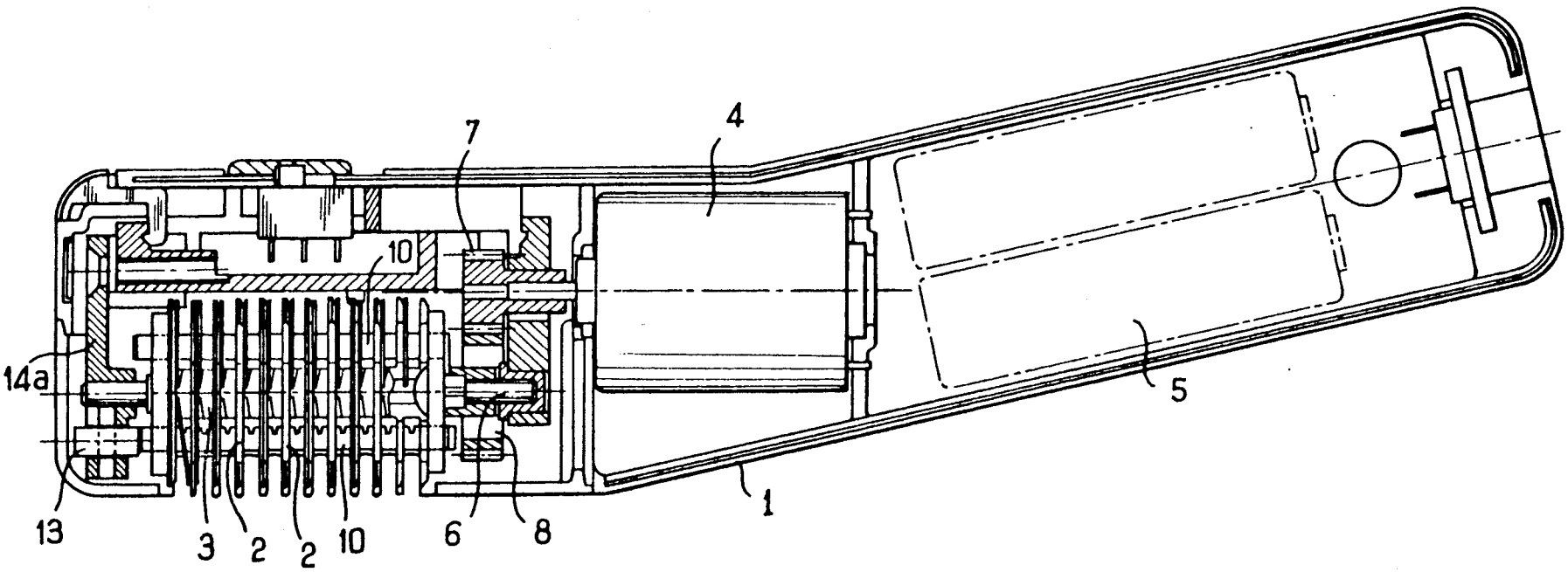

The present invention relates to a depilating apparatus intended to be held in the hand and for removal of superfluous hairs.

European Patent Application No. 147,285 makes known a depilating apparatus intended to be held in the hand, comprising a series of parallel disks fixed on a hub driven in rotation by an electric motor, blades arranged between the disks, and means for bringing said blades into contact with the periphery of the disks and separating them therefrom alternately as the disks rotate, said means possessing rods which cooperate with the blades and are able to slide parallel to the axle of the hub.

The sliding of these rods is controlled by a fixed cam carried by that end of the housing which is adjacent to the rods. This cam pushes the rods counter to the action of a return spring situated opposite the cam.

In this apparatus, the blades are integral with the rod which carries them, so that, when this rod slides, the blades are displaced together parallel to one another and therefore, in principle, simultaneously come into contact with the disks to produce a pinching effect capable of removing hairs from the skin.

Owing to the fact that the blades are fixed relative to the rod which carries them, it is necessary, to obtain simultaneous contact of the blades on the disks, to determine with great precision the position of the blades relative to the disks.

This disadvantage affects the cost and the efficiency of this apparatus.

The object of the present invention is to overcome the disadvantage of the known embodiment by creating a depilating apparatus which is, in particular, more efficient, easier to manufacture and therefore also less expensive.

The invention thus sets out to provide a depilating apparatus intended to be held in the hand, comprising a series of parallel disks fixed on a hub driven in rotation by an electric motor, blades arranged between the disks, and means for bringing said blades into contact with the periphery of the disks and separating them therefrom alternately as the disks rotate, said means possessing rods which cooperate with the blades and are able to slide parallel to the axle of the hub.

According to the invention, this apparatus is defined in that the hub comprises, between the disks, a series of notches which each retain one end of a blade, each rod comprising a series of notches, each of these notches retaining a part of a blade situated between its above-mentioned end and its other end, which is capable of coming to bear against the periphery of a disk, said notches being shaped so as to permit a pivoting movement of the blades between a position remote from the disks and a position in contact with the periphery of the latter.

The blades are thus held between two series of notches formed on the hub and on the rod respectively, so that the sliding of this rod causes the blades to pivot in the notches of the hub, these notches as well as those formed on the rod constituting points of articulation.

By virtue of this pivoting of the blades, the ends of the latter come into contact with the periphery of the disks and produce a pinching effect capable of removing hairs from the skin. Owing to this pivoting of the blades and their flexibility, the latter are simultaneously brought into contact with the periphery of the disks without it being necessary to produce components with very precise dimensions.

Moreover, the notches can be constructed so as to permit a certain amount of play of the parts of the blades being held, this play making it possible to compensate any variations caused by large-scale manufacture and thus to perfect the simultaneity of contact between the blade and the disks.

Furthermore, the construction of notches in the hub and the blade-control rods is a simple operation which permits easy assembly of the blades, the number of components to be assembled being extremely small.

According to an advantageous embodiment of the invention, the apparatus possesses two rods arranged on each side of the hub and sliding in opposite directions relative to one another in such a manner that, when the blades pushed by one of the rods are bearing on the disks, the blades pushed by the other rod are remote from the disks and vice versa.

This arrangement increases the efficiency of the apparatus.

According to a preferred embodiment of the invention, each blade has, at its end adjacent to the hub, two parallel lugs engaged in two spaced notches formed on the hub.

This arrangement ensures excellent guidance of the blades in their pivoting movement.

According to another feature of the invention, the disks and the hub are constructed in one piece from molded plastic material.

This plastic material may be fiber-reinforced. This plastic material may be replaced by a ceramic material, or a light metal or alloy such as aluminum or zamak.

The fact that the above rotating assembly is in one piece facilitates the assembly of the apparatus, enables its cost to be reduced and reduces the noise of the apparatus.

Preferably, the disks each have a flat surface parallel to the two openings for the passage of the rods, this flat surface being situated alternately on one side of the hub and on the other side thereof for the successive disks.

Other special features and advantages of the invention will also become apparent from the description below.

Figure 2:
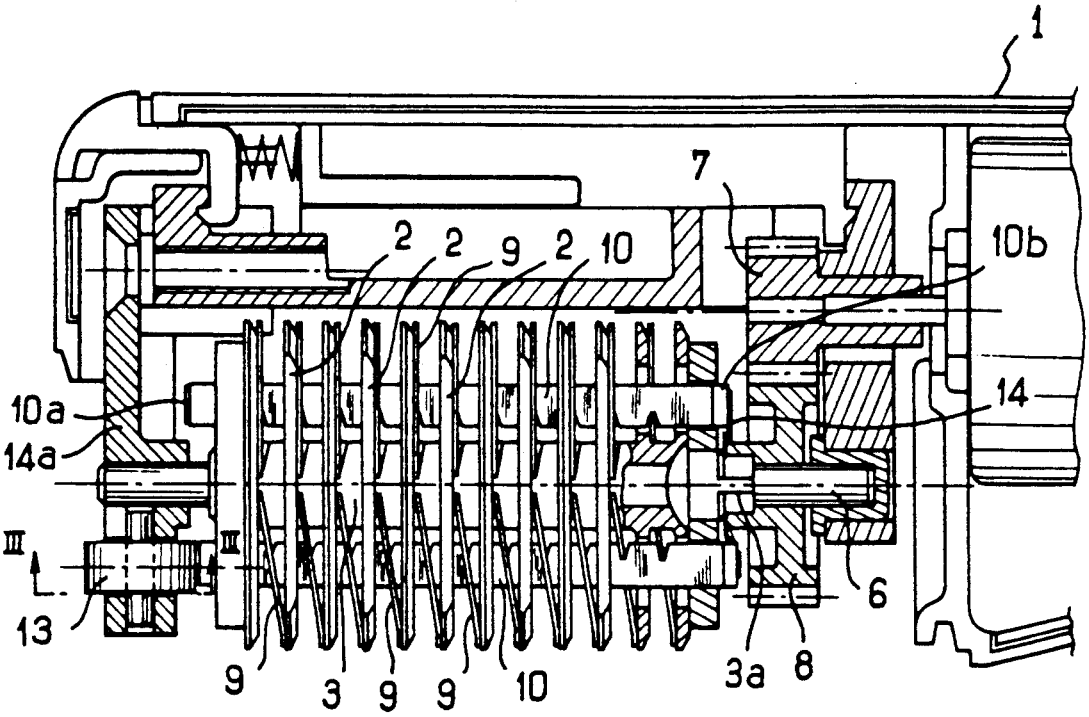
Figure 3:
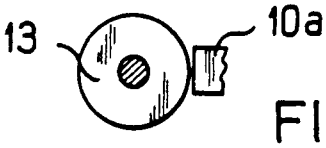
Figure 4:
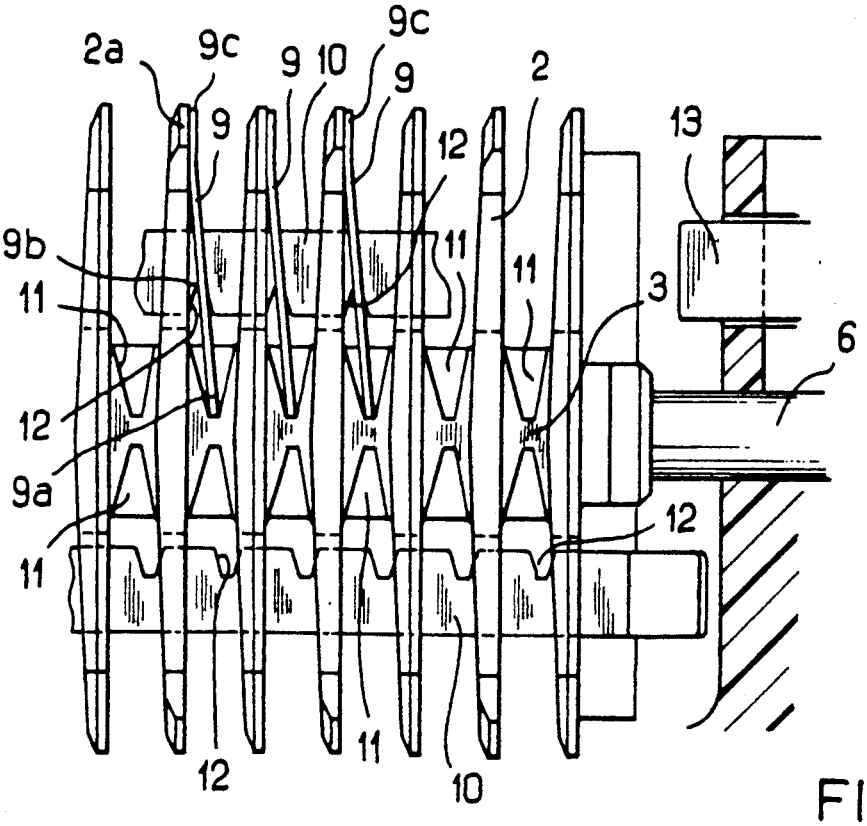
Figure 9:
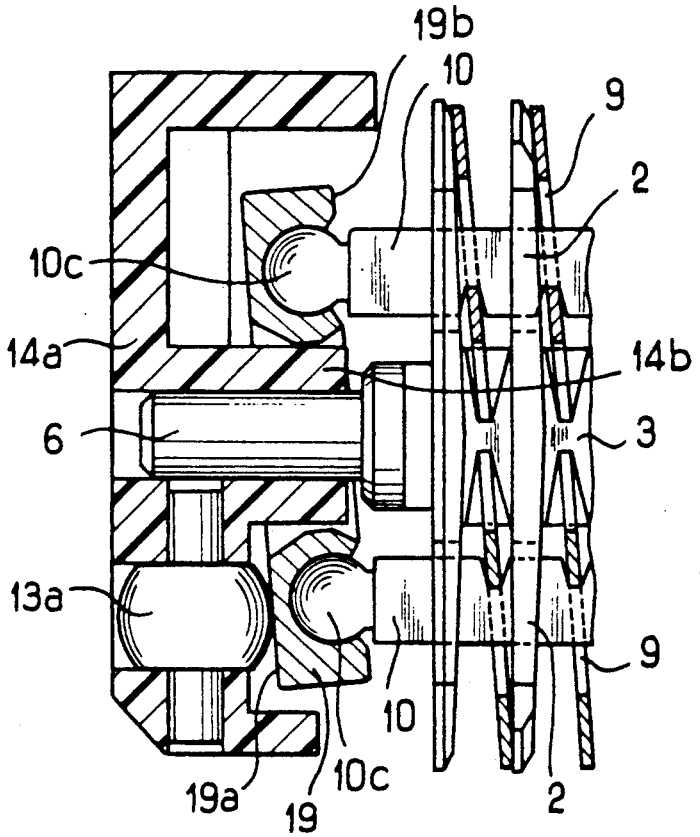
Figure 10:
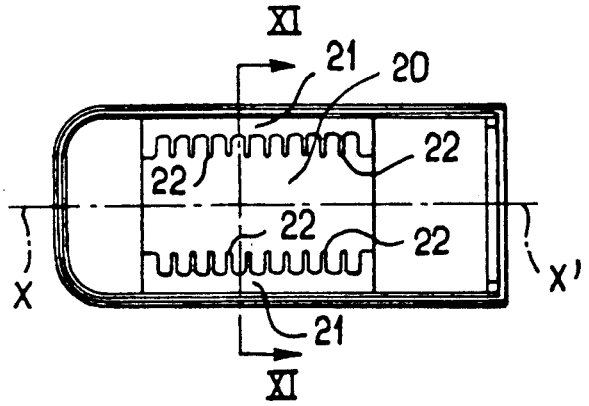
Figure 11:
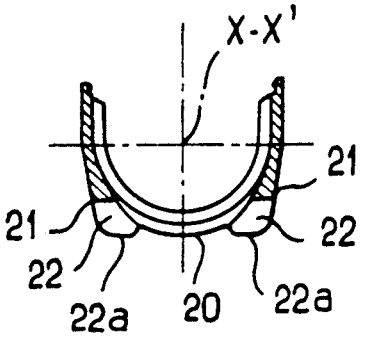
Figure 5:
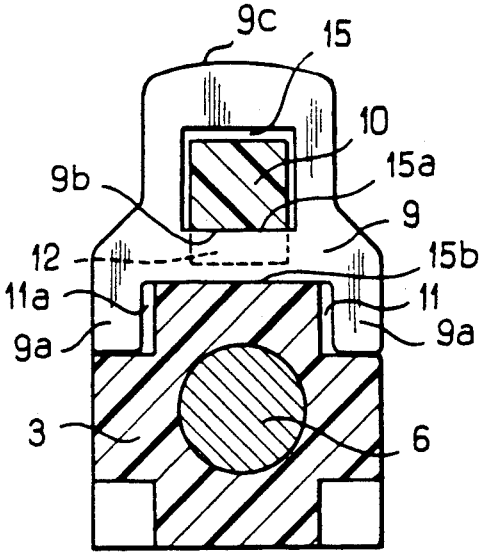
Figure 6:
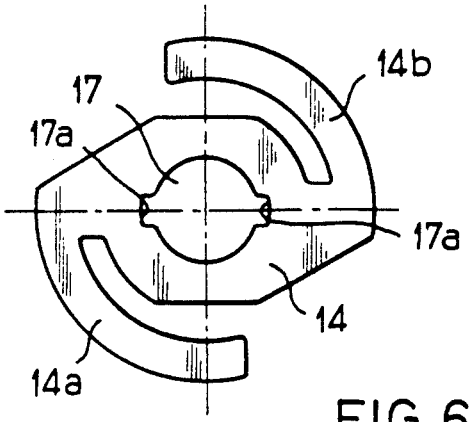
Figure 7:
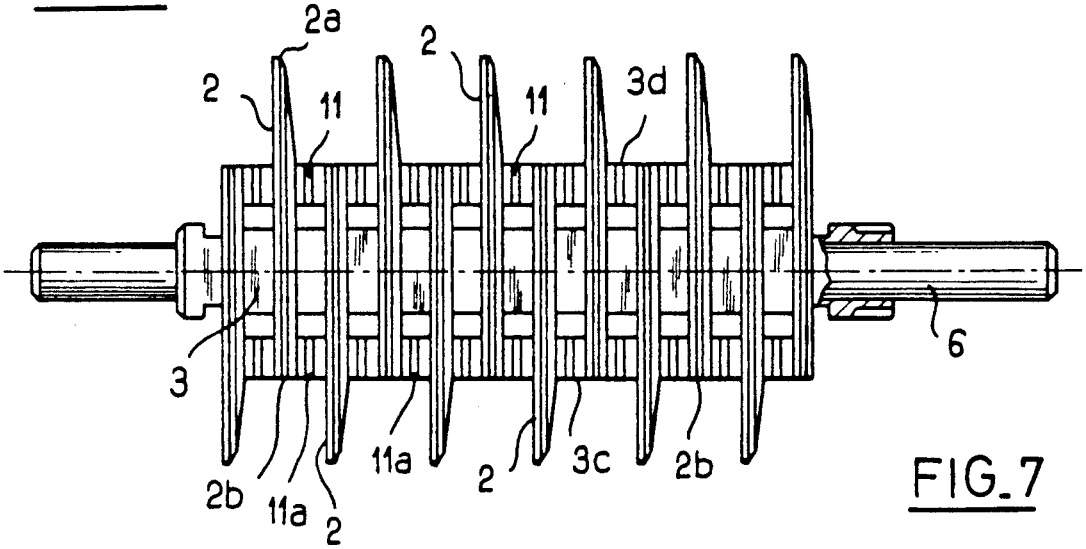
Figure 8:
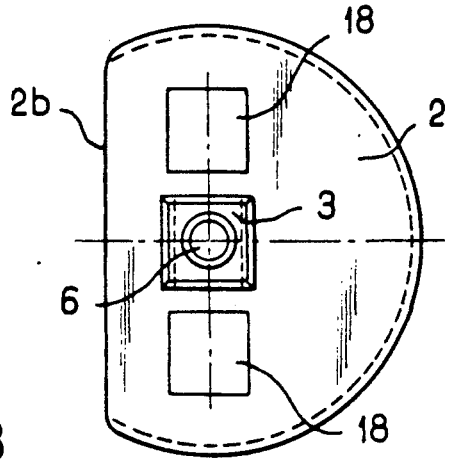

In the accompanying drawings given by way of non-limiting examples:

FIG. 1 is a plan view of the depilating apparatus according to the invention, after removal of part of its housing and in partial longitudinal section, FIG. 2 is a view, to a larger scale, of the front part of the apparatus, FIG. 3 is a sectional view according to the plane III—III of FIG. 2, FIG. 4 is a partial plan view of the hub, the disks and the blade-control rods, FIG. 5 is a plan view of a blade engaged on the hub and a control rod, shown in cross section, FIG. 6 is a plan view of the return spring of the control rods, FIG. 7 is a plan view of the hub and the disks, FIG. 8 is an end view of the assembly shown in FIG. 7, FIG. 9 is a partial sectional view of the end of an alternative embodiment of the apparatus, showing the rod-control members, FIG. 10 is a diagrammatic top view of the apparatus, showing the teeth forming a comb, FIG. 11 is a sectional view according to the plane XI—XI of FIG. 10.

In the embodiment of FIGS. 1 and 2, the depilating apparatus intended to be held in the hand comprises, inside a housing 1, a series of parallel disks fixed on a hub 3 driven in rotation by an electric motor 4 powered by batteries 5. The transmission between the output shaft of the motor 4 and the axle 6 of the hub is produced by means of gears 7, 8 made of plastic material.

Arranged between the disks 2 are blades 9, means being provided for bringing said blades 9 into contact with the periphery of the disks 2 and separating them therefrom alternately as the disks rotate. These means possess rods 10 which cooperate with the blades 9 and are able to slide parallel to the axle of the hub 3.

In accordance with the invention, the hub 3 comprises, between the disks 2 (see FIGS. 1, 2 and 4), a series of notches 11 which each retain one end 9*a* of a blade 9. Each rod 10 comprises a series of notches 12 open towards the notches 11 of the hub 3. Each notch 12 of a rod 10 retains a part 9*b* of a blade 9 situated between its end 9*a* and its other end 9*c*, which is capable of coming to bear against the periphery 2*a* of a disk 2.

The notches 11 and 12 open out towards the outside of the hub 3 and the rods 10 so as to permit a pivoting movement of the blades 9 between a position remote from the disks 2 and a position in contact with the periphery 2*a* of the latter.

In the example illustrated by the accompanying figures, the depilating apparatus possesses two rods 10 arranged on each side of the hub 3 and sliding in opposite directions relative to one another in such a manner that, when the blades 9 pushed by one of the rods 10 are bearing on the disks 2, the blades 9 pushed by the other rod are remote from the disks and vice versa (see in particular FIGS. 1 and 2).

In the embodiment of FIGS. 1 and 2, the displacement of the rods 10 is controlled by a wheel 13 mounted rotatably in an end plate 14*a* comprising one of the bearings of the axle 6 of the hub 3, the axis of rotation of the wheel 13 being perpendicular to the axle 6 of the hub 3 and this wheel 13 projecting from the face of the end plate 14*a*, adjacent to the assembly of hub 3 and disks 2.

As the hub 3 carrying the disks rotates, the projecting ends 10*a* of the rods 10 are able to mount the wheel 13 successively, which has the effect of pushing these rods 10 towards the right of FIGS. 1 and 2 counter to the action of a return spring 14 which will be explained in detail hereinbelow.

Preferably, the blades 9 are made of elastic material, such as stainless steel or a sufficiently flexible and resistant plastic material.

It can be seen in FIG. 5 that each blade 9 has a passage opening 15 for the control rod 10.

In addition, the notches 12 of the rods 10 are each engaged on that edge 15*a* of the opening 15 of the blade which is closest to the hub.

FIG. 5 also shows that the end 9*c* of each blade 9 intended to come to bear on the periphery 2*a* of the adjacent disk 2 has a curvature corresponding to that of the disk.

In addition, each blade 9 has, at its end adjacent to the hub 3, two parallel lugs 9*a* engaged in two spaced notches 11, 11*a* formed on the hub 3 and opening on two opposite faces of the latter. The two lugs 9*a* define a recess 15*b* between them.

As indicated in FIG. 2, the two rods 10 are pushed back by a spring 14 integral with the end 3*a* of the hub 3. This spring 14 is (see FIG. 6) cut out from a plane spring-steel foil and has two opposite tongues (14*a*, 14*b*) which bear on the respective ends 10*b* of the rods 10. These tongues 14*a*, 14*b* are in the form of arcs of a circle centered on the axle 6 of the hub 3. The spring 14 has a center hole 17 engaged on the end 3*a* of the hub 3 and having two diametral notches 17*a* which enable the spring 14 to be made integral with the hub 3.

The assembly shown in FIG. 7, consisting of the disks 2 and the hub 3 may be constructed in one piece from plastic material molded onto a steel axle 6.

This plastic material may be reinforced with glass fibers or the like. The assembly may also be made of ceramic.

Additionally, it can be seen in FIGS. 1, 2, 4 and 7 that the periphery 2*a* of the disks 2 is chamfered on the side opposite that which receives the end of the blades 9.

The FIGS. 7 and 8 show, moreover, that the disks 2 each have a flat surface 2*b* parallel to the two openings 18 for the passage of the rods 10. This flat surface 2*b* is situated alternately on one side of the hub 3 and the other side thereof for the successive disks 2.

Furthermore, the flat surfaces 2*b* are flush with the corresponding edge 3*c* or 3*d* of the hub 3.

In the alternative embodiment of FIG. 9, the sliding movement of the two rods 10 for controlling the blades 9 is controlled, as before, by a wheel 13*a* mounted rotatably in the end plate 14*a* along an axis perpendicular to that of the hub 3. According to this alternative embodiment, a disk 19 is mounted pivotably on the bearing 14*b* formed in the end plate 14*a* in which the axle 6 of the hub is mounted rotatably.

One 19*a* of the faces of the pivotable disk 19 bears on the wheel 13*a* and the other face 19*b* of this disk receives the ends of the rods 10 in articulated manner. In this example, the articulation comprises balls 10*c*.

In this alternative embodiment, the frictional forces and therefore wear are limited owing to the fact that the various components pivot or roll on one another without appreciable friction.

In the embodiment of FIGS. 10 and 11, the housing 1 of the depilating apparatus comprises, as before, an opening 20, under which the disks 2 are arranged and which enables the latter to be brought into contact with the skin from which the hair is to be removed.

This opening 20 has two longitudinal edges 21, parallel to the axis X—X' of the hub 3 carrying the disks 2, which each possess a set of teeth 22 forming a comb. The ends 22*a* of these teeth 22 (see FIG. 11) are rounded and form on each of said longitudinal edges 21 a bearing surface intended to come into contact with the skin from which the hair is to be removed.

The main technical advantages of the hair-removing apparatus which has just been described will now be explained in detail.

Overall, this apparatus has an improved efficiency, a simplified construction and assembly and reduced wear and is quieter in operation than the known hair-removing apparatuses.

The improved efficiency results from the pivotable mounting of the blades 9, which enables the latter to bear simultaneously and with the same force on the periphery of the disks, thereby guaranteeing an optimum hold on the hairs over a large area.

This efficiency may be further improved by shaping the periphery 2*a* of the disks 2 in such a manner that the edge 9c of the blades 9 bears over its entire length on a part of the periphery 2a of the disks 2, thereby, at the same time, reducing wear on the latter.

In addition, the hold on the hairs could be further improved by providing roughness on the surface of contact between the disks 2 and the blades 9.

The construction and assembly are simplified by using a very small number of components. In fact, the assembly consisting of the axle 6, the hub 3 and the disks 2 is in one piece.

In addition, the blades 9 do not require any other means for controlling, assembling and guiding than the notches of the hub 3 and those of the rods 10. In addition, the latter are guided in a simple manner by openings 18, of the same cross section, made in the disks.

Furthermore, the return spring 14 serves at the same time for pushing back the two rods 10, and its axial space requirement is extremely small.

The wear on the apparatus in operation is reduced in particular owing to the fact that the friction has been replaced by rolling movements, in particular in the case of the embodiment according to FIG. 9.

The reduction of the friction, the reduction of the number of movable components with play, and the use of plastic material for the disks and the gears also enable the apparatus to operate very quietly.

Of course, the invention is not limited to the exemplary embodiments which have just been described, and it is possible to make numerous modifications to the latter without departing from the scope of the invention.

For instance, in the case of the embodiment shown in FIG. 9, the face of the disk 19 bearing on the wheel 13a could comprise raised projections forming cams.

Furthermore, the notches 11 and 12 could be open in opposite directions instead of being open towards one another.

We claim:

1. A hand held depilating apparatus comprising:

a housing (1);

an elongated hub (3) supported by said housing for rotation about the longitudinal axis of said hub;

a plurality of parallel disks (2) fixed to said hub, said disks being separated by longitudinal spaces and each having a periphery (2a) spaced from said hub, said hub having at least one hub notch (11) in each of said longitudinal spaces;

a plurality of blades (9), at least one such blade (9) for each of said disks, each of said blades having one end received in said hub notch (11) and another end adapted to contact one of said disks near the periphery (2b) thereof; and means for bringing said blades (9) into contact with the periphery (2a) of said disks (2) and separating them therefrom alternately as the disks rotate with said hub, said means including at least one rod (10) extending parallel to the axis of said hub and supported for longitudinal sliding movement, said rod having rod notches (12) for retaining a part of each blade (9) located between said one end and said other end, said hub notches (11) and said rod notches (12) being shaped to permit pivoting movement of said blades (9) upon longitudinal movement of said rod between a position spaced from the respective disks (2) and a position in contact with the periphery (2a) of the disks.

2. The depilating apparatus as claimed in claim 1, wherein said hub notches (11) open out towards the outside of the hub (3) and said rod notches (12) open out towards the outside of said rod (10).

3. The depilating apparatus as claimed in claim 1 wherein said means for bringing said blades (9) into contact includes two rods (10) extending parallel to the axis of said hub and arranged one on each side of the hub (3), said rods being adapted to slide longitudinally in opposite directions relative to one another, in such a manner that, when the blades (9) pivoted by one of the rods are bearing on the disks (2), the blades pivoted by the other rod are remote form the disks and vice versa.

4. The apparatus as claimed in claim 3, including a spring (14) integral with the hub (3), cut out from a spring-steel foil, and having two opposite tongues (14a, 14b) bearing on the respective ends of said rods (10) to bias said rods in one direction of longitudinal movement.

5. The apparatus as claimed in claim 4, wherein said tongues (14a, 14b) are of arcuate configuration and centered on the axle of the hub (3).

6. The apparatus as claimed in claim 3, wherein each of said disks (2) includes a pair of diametrical openings (18) for receiving said rods (10) and a flat surface (2b) parallel to the diameter of said openings (18), said flat surface (2b) being located alternately on opposite sides of the hub (3) for the successive disks.

7. The apparatus as claimed in claim 6, wherein said hub (3) includes a pair of opposite flat surfaces (3c, 3d) said flat surfaces (2b) on said disks being flush with the corresponding flat surface of the hub (3).

8. The apparatus as claimed in claim 3 comprising a wheel (13a) for controlling the sliding movement of said rods (10), said wheel (13a) being mounted rotatably on said housing at one end of said rods and on an axis perpendicular to that of the hub (3), a pivotal disk (19), a bearing (14b) carried by the the housing for supporting said pivotal disk so that one (19a) of the faces of the pivotal disk (19) bear on the wheel (13a), and means on the other face (19b) of said pivotal disk for receiving the ends (10c) of the rods (10) in articulated manner.

9. The apparatus as claimed in claim 1, wherein said blades (9) are made of elastic material.

10. The apparatus as claimed in claim 1, wherein said part of each blade (9) between said ends defines an opening (15) to receive the rod (10).

11. The apparatus as claimed in claim 10, wherein said opening includes an edge (15a) between the opening and said hub, each of the rod notches (12) receiving said edge (15a).

12. The apparatus as claimed in claim 10, wherein each of said hub notches includes two spaced notch segments (11, 11a) and wherein said one end of said blade includes two parallel lugs (9a) received in said notch segments.

13. The apparatus as claimed in claim 1, wherein said other end (9c) of each blade (9) adapted to contact one of said disks (2) has a curvature corresponding to the periphery (2a) of the disks (2).

14. The apparatus as claimed in claim 1, wherein said disks (2) and said hub (3) are constructed from one piece of molded plastic material.

15. The apparatus as claimed in claim 1, wherein the periphery (2a) of each of said disks (2) is chamfered on the side opposite form the side thereof contacted by said other end (9c) of the respective blades (9).

16. The apparatus as claimed in claim 1, wherein said housing defines an opening (20) under which the disks are arranged, said opening (20) having two longitudinal edges (21) parallel to the axis of the hub (3), each of said longitudinal edges (21) having a set of teeth (22) forming a comb, the ends (22*a*) of said teeth (22) being rounded and forming on each of said longitudinal edges (21) a bearing surface to come into contact with the skin from which the hair is to be removed, thus limiting the pressure of the disks on the skin.

* * * * *

UNITED STATES PATENT AND TRADEMARK OFFICE

CERTIFICATE OF CORRECTION

PATENT NO. : 5,041,123

DATED : AUGUST 20, 1991

INVENTOR(S) : PATRICE OLIVEAU ET AL.

It is certified that error appears in the above-identified patent and that said Letters Patent is hereby corrected as shown below:

Title Page, Inventors, change "Fontaine" to --Fontaine/Saone--.

Title page:
Abstract, line 15, after "skin." insert --(See figure 4)--.

Claim 3, column 6, line 11, change "form" to --from--.

Claim 13, column 6, line 58, change "disks" to --disk--.

Claim 15, column 6, line 64, change "form" to --from--.

Signed and Sealed this

Second Day of February, 1993

*Attest:*

STEPHEN G. KUNIN

*Attesting Officer*

*Acting Commissioner of Patents and Trademarks*